US009388590B1

(12) United States Patent
Ladd

(10) Patent No.: US 9,388,590 B1
(45) Date of Patent: Jul. 12, 2016

(54) BRICK CHIMNEY GUIDE

(71) Applicant: Daniel John Ladd, Belfast, ME (US)

(72) Inventor: Daniel John Ladd, Belfast, ME (US)

( * ) Notice: Subject to any disclaimer, the term of this patent is extended or adjusted under 35 U.S.C. 154(b) by 0 days.

(21) Appl. No.: 14/121,078

(22) Filed: Jul. 28, 2014

(51) Int. Cl.
*E04G 21/18* (2006.01)
*E04G 21/16* (2006.01)
*E04G 21/22* (2006.01)

(52) U.S. Cl.
CPC ..... *E04G 21/164* (2013.01); *E04G 21/22* (2013.01)

(58) Field of Classification Search
CPC . E04G 21/18; E04G 21/1808; E04G 21/1816; E04G 21/22
USPC ..... 52/749.13–749.15, 514; 33/404, 407, 33/408, 410
See application file for complete search history.

(56) References Cited

U.S. PATENT DOCUMENTS

| | | | | |
|---|---|---|---|---|
| 2,641,846 | A | 2/1950 | Zeno | |
| 3,768,167 | A | 10/1973 | Viau | |
| 4,338,728 | A | 7/1982 | Valead | |
| 5,129,150 | A * | 7/1992 | Sorensen | 33/408 |
| 5,722,176 | A | 3/1998 | Hinson | |
| 5,915,809 | A | 6/1999 | Gilliam | |
| 5,970,668 | A * | 10/1999 | Arthurs | E04G 23/0218 52/167.1 |
| 6,860,024 | B2 | 3/2005 | Kirk | |
| 8,595,947 | B2 | 12/2013 | Cade | |
| 2005/0086901 | A1 * | 4/2005 | Chisholm | 52/749.1 |
| 2008/0006005 | A1 * | 1/2008 | Bashour | 52/749.14 |

* cited by examiner

*Primary Examiner* — William Gilbert

(57) ABSTRACT

The brick chimney guide is an apparatus for holding successive brick courses in proper alignment during the construction of brick chimneys or columns. The apparatus is comprised of four angle upright members mutually connected by eight horizontal bars. The end of each horizontal bar is held frictionally by corner brackets at the top and bottom of each angle upright member. The guide is attached to a chimney by jacking screws on the bottom of each of the four angle upright members. The screws hold the guide in place by friction and help align the guide in a plumb and square manner. The angle upright members physically maintain each of the four corners of the brick structure in vertical alignment throughout the construction process.

1 Claim, 5 Drawing Sheets

BRICK CHIMNEY GUIDE

BACKGROUND OF THE INVENTION

1. Technical Field

This invention relates to a masonry guide for use in laying bricks in general and more particular to the laying of brick chimneys or brick columns.

2. Background Information

Masonry guides have long been used to aid the mason in proper alignment of successive courses of brick or block. A specific aspect of masonry deals with the construction of brick chimneys or columns. Such chimneys that are built from brick typically extend above the roof several feet. It is essential that each successive course be both level and plumb, as many chimneys are highly visible and decorative. The time spent leveling and aligning corners add significantly to the construction cost. It is therefore highly desirable to use a device for reducing labor cost. However, many patents teach the necessity of attaching the guides in some manner to the frame structure adjacent to the brick work. When constructing the brick chimney above the roof there may be no adjacent framing structures available to which a guide can be attached or leveled on a sloped roof.

The present invention attaches to the previously constructed segment of the chimney with no need to attach to the structure of the building. Prior art may only indicate the aligned position of the bricks however the present invention not only indicates the proper alignment but physically holds the bricks in position. No other masonry guide is designed to plumb and hold all four corners of a brick chimney throughout construction or is attached solely to the masonry structure being built.

Unlike other guides or plumbing devices used for constructing brick columns the chimney guide holds each of the lower courses immobile and becomes even more stable as the column of brick is built up in each successive course.

BRIEF SUMMARY OF THE INVENTION

This invention is an apparatus for holding successive brick courses in proper alignment during the construction of brick chimneys or columns. The brick chimney guide consists of four angle upright members that physically constrain each of the four corners. When constructed of aluminum or polymeric materials it is both light weight and economical. The guide can be rapidly set up and is adjustable to fit a variety of sizes from the smallest single flue chimney to the largest multi flue brick chimney. Once the chimney guide is attached to the first courses of brick, it can be quickly plumbed and squared. One of the main advantages of this guide is that it physically holds each of the four corners of the chimney plumb, throughout the construction of the chimney. The guide also produces a perfect corner regardless of the skill of the brick layer. When a brick spacing rule is incorporated in the guide, the mason can lay each successive course of brick without the use of a level for plumbing the corners or for leveling the brick courses. The brick chimney guide increases the speed of construction by a significant amount and reduces the cost of the project. The chimney guide is self supporting in that each of the four angle upright members are attached to each of the other four posts by eight horizontal support bars. The chimney guide, affixed to the previously completed section provides a high degree of stability and precision in building the brick chimney where every course of brick is perfectly square and aligned with every other.

BRIEF DESCRIPTION OF DRAWINGS

A more comprehensive understanding of the invention and its advantages are shown in the five detailed drawings and the following descriptions.

LIST OF REFERENCE NUMBERS USED IN THE DRAWINGS

Figure 1:
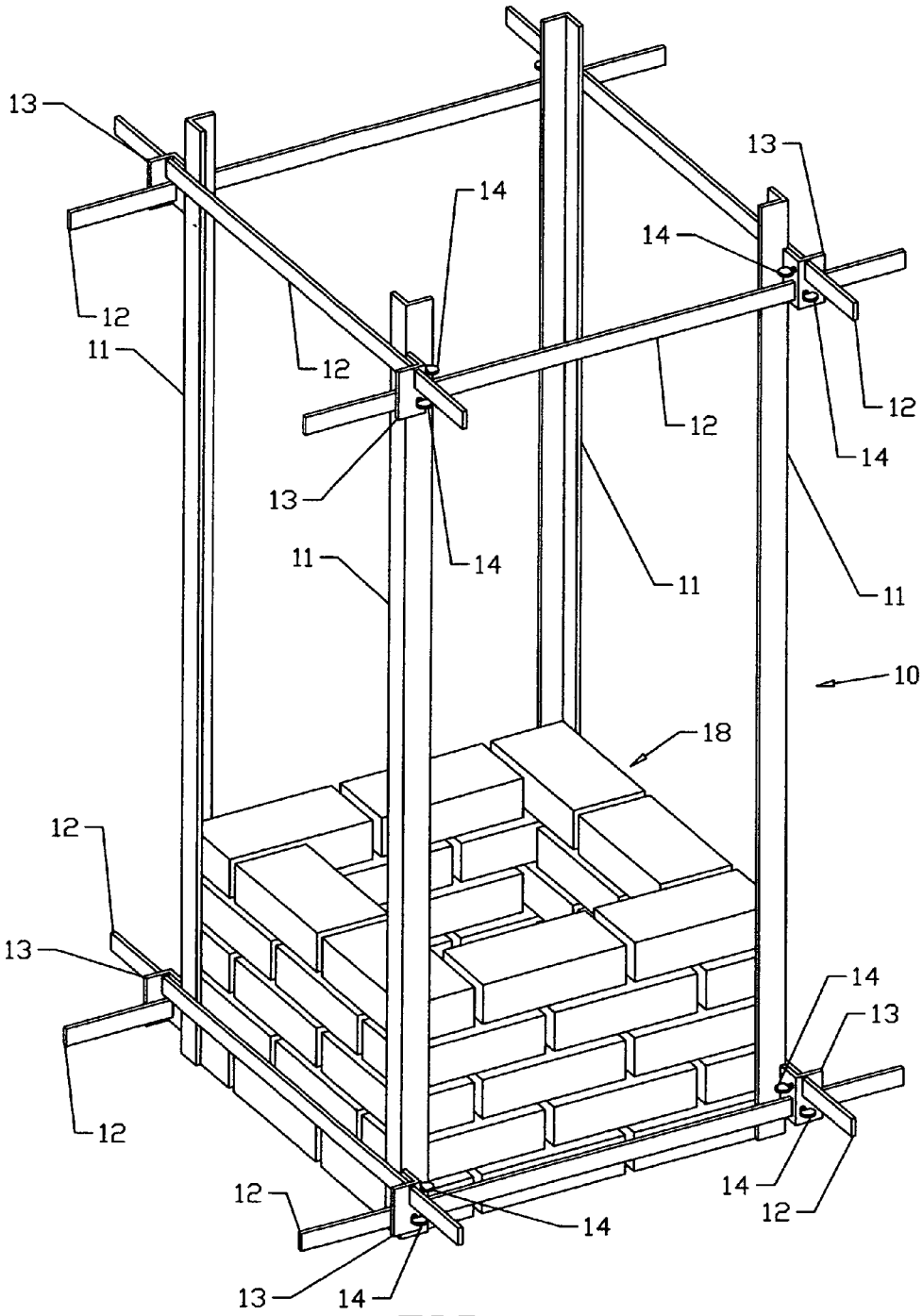
FIG. 1 is a perspective view of the brick chimney guide showing the device attached to the brick courses of a chimney.

10 brick chimney guide
11 angle upright member
12 horizontal support bar
13 corner bracket
14 thumb screw
15 keeper slot
16 threaded screw hole
17 jacking screw
18 brick chimney

DETAILED DESCRIPTION OF THE INVENTION

The brick chimney guide 10 is comprised of vertical members extending upward and connected by horizontal links. The four angle upright members 11 are installed at the corners of the previous built masonry and joined together by eight horizontal support bars 12. The horizontal support bars 12 are inserted into keeper slots 15 in the upper and lower corner brackets 13, the angle upright members 11 are adjusted to the precise outside dimension of the masonry and thumb screws 14 are tightened to hold each bar 12 in its keeper slot 15. The chimney guide 10 is then aligned plumb in two vertical planes by using jacking screws 17 at lower end of each angle upright member 11. A brick layer's scale is affixed to one or more of the angle upright members 11 to facilitate the chimney building.

Figure 2:
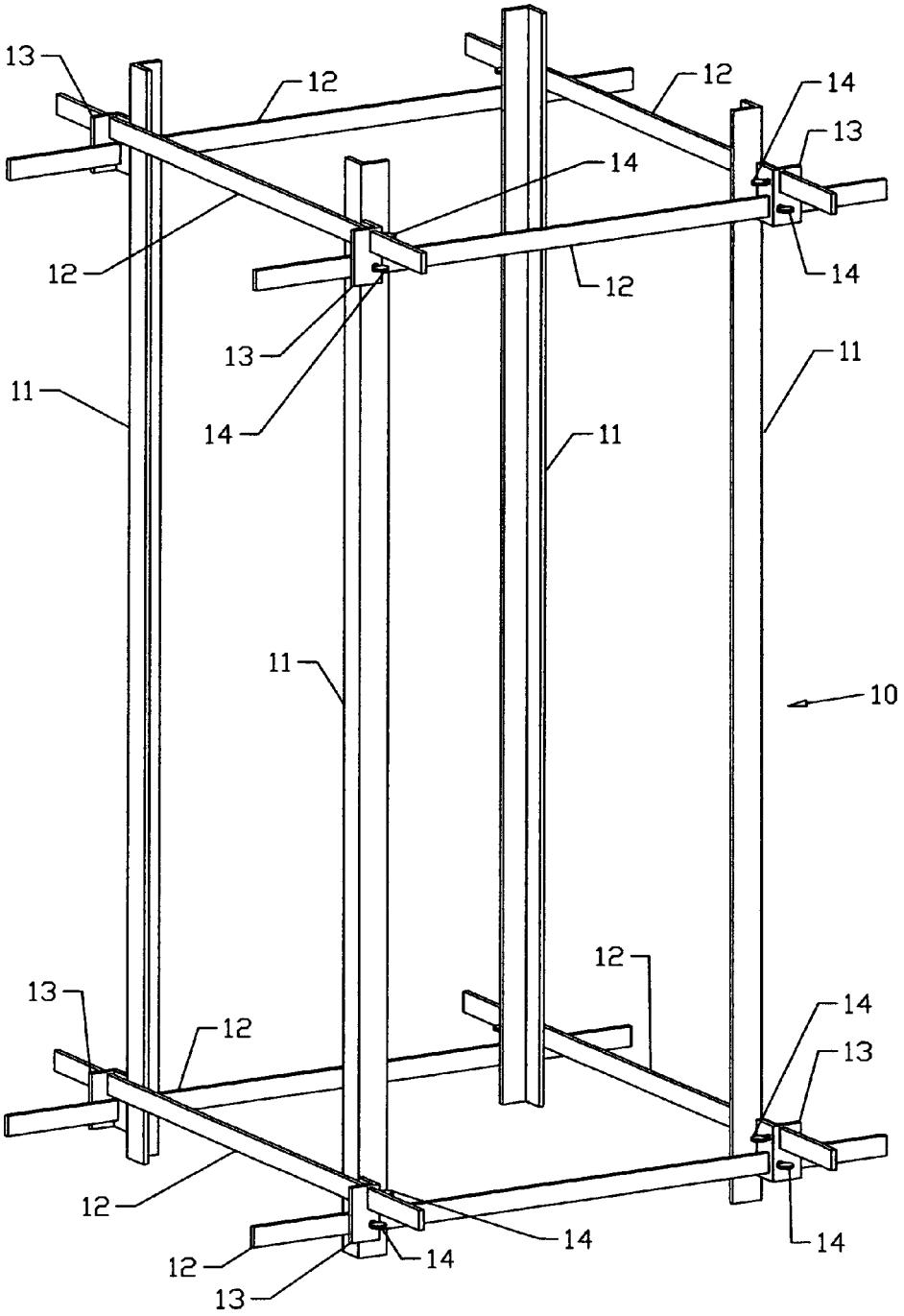
FIG. 2 is a perspective view of the single apparatus.
Figure 3:
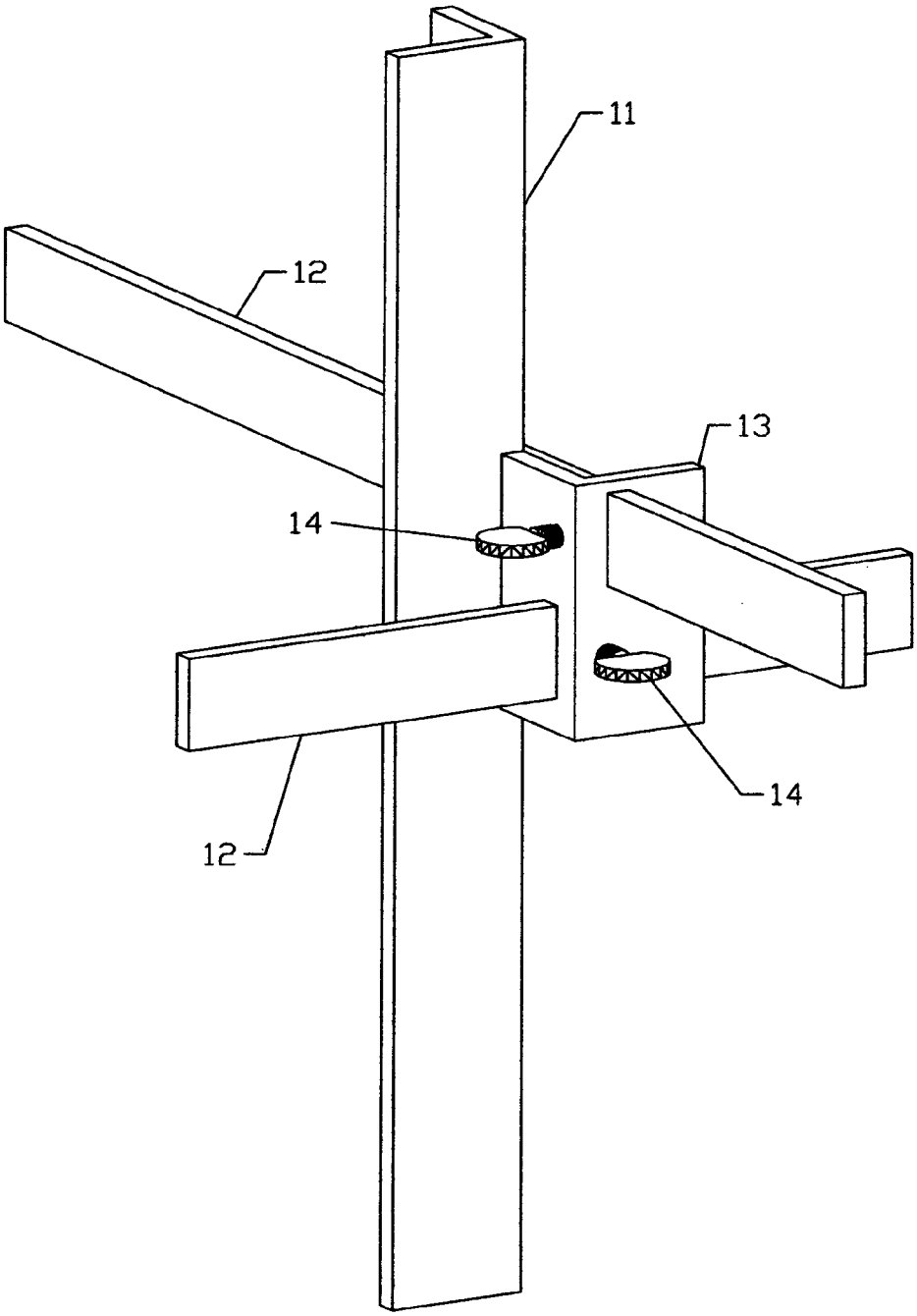
FIG. 3 is a close up view of the upper corner bracket with two horizontal support bars in their keeper slots held by two thumb screws.
Figure 4:
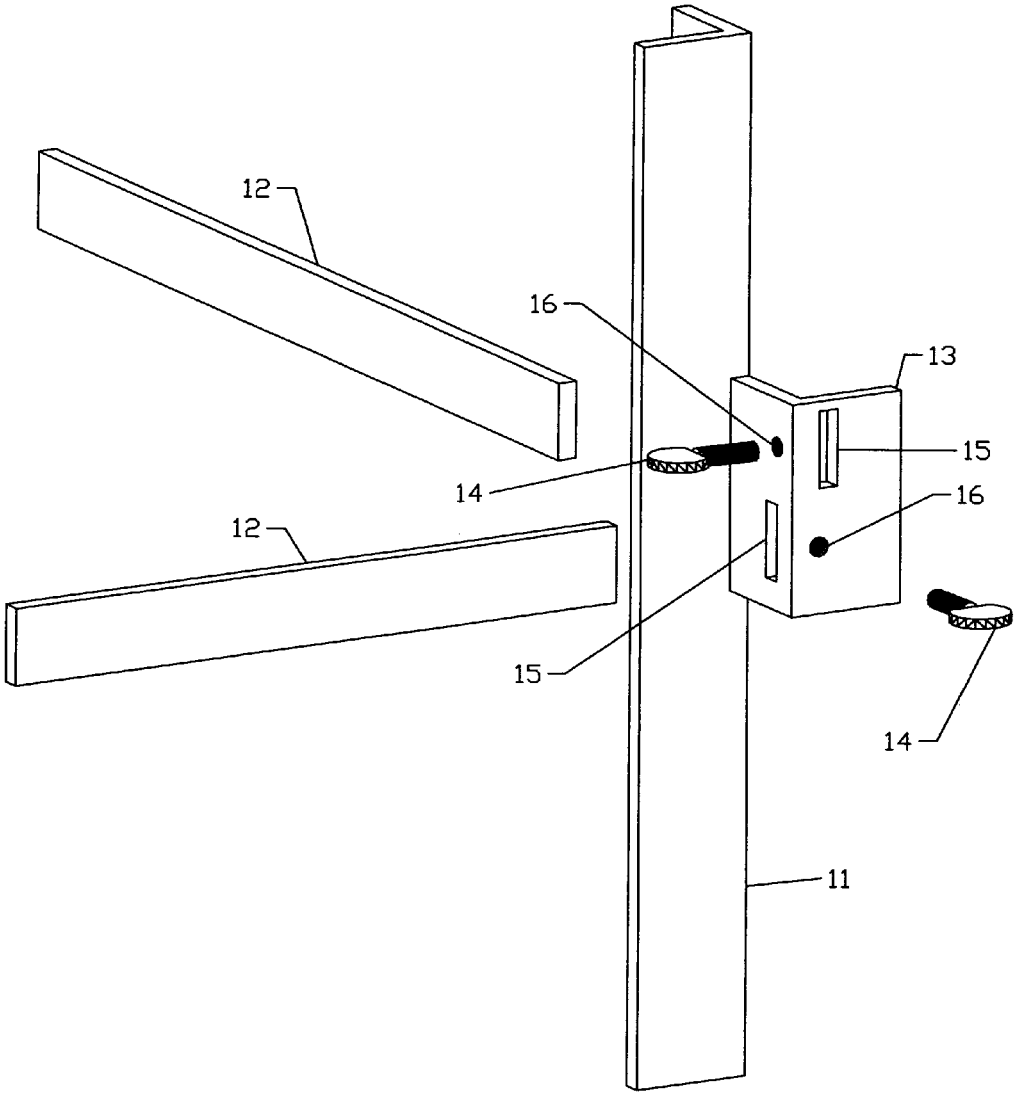
FIG. 4 is an exploded view of the apparatus illustrated in FIG. 3.
Figure 5:
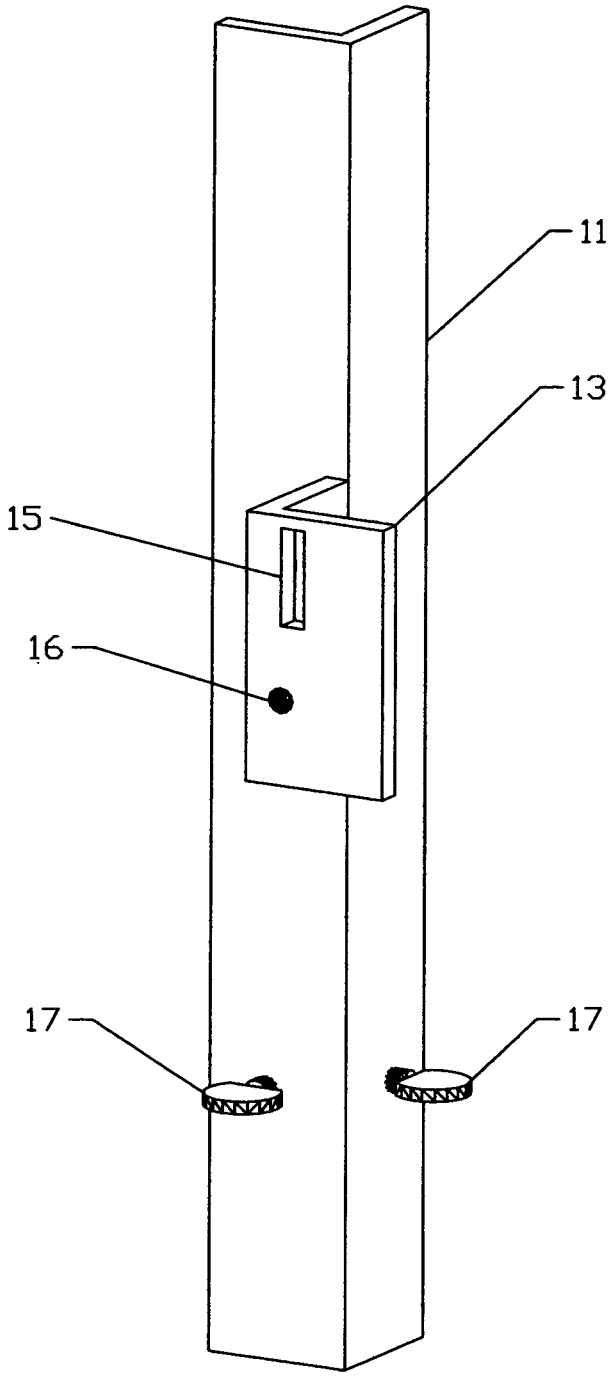
FIG. 5 is a close up view of the lower corner bracket with its keeper slot and jacking screws.

The brick chimney guide 10 in FIG. 1 is shown attached to a previously constructed section of a brick chimney 18 and is comprised of four angle upright members 11 each with lower and upper corner brackets 13. In FIG. 4 each corner bracket 13 has two keeper slots 15 used to hold horizontal support bars 12 which connect each angle upright member 11 to adjacent angle upright members 11. In FIG. 3 horizontal support bars 12 are captured in keeper slots 15 with screws 14 which allow each angle upright member 11 to be adjustable to a variety of sizes. At the bottom of each angle upright member 11 there are two threaded holes 16 which receive jacking screws 17 for anchoring the chimney guide 10 to the previously laid brick courses 18. In FIG. 2 the chimney guide 10 is shown self supporting. The jacking screws 17 are shown on the lower portion of the angle upright members 11. FIG. 5 is a detailed view of the jacking screws 17 with the corner bracket 13 and its keeper slot 15 which has threaded holes 16 for the thumb screws 14.

I claim:

1. A chimney alignment guide comprising:

a first, a second, a third and a fourth longitudinal member, each said longitudinal member comprising an angle shape having a first flange and a second flange connected to said first flange, each said longitudinal member having a first longitudinal end and a second longitudinal end;

each said longitudinal member further comprising a first and a second bracket; each said first bracket connected to a respective one of said longitudinal members proximate said first longitudinal end and each said second bracket connected to a respective one of said longitudinal member proximate said second longitudinal end, each of said brackets further comprising a first tab and a second tab connected to said first tab, each of said brackets further comprising a first opening on each said first tab and a second opening on each said second tab;

a first, a second, a third and a fourth longitudinal bar, said first longitudinal bar being received in said first opening of said first respective bracket of said first longitudinal member and in said first opening of said first bracket of said second longitudinal member, said second longitudinal bar being received in said first opening of said first respective bracket of said third longitudinal member and in said first opening of said first bracket of said fourth longitudinal member, said third longitudinal bar being received in said second opening of said first respective bracket of said first longitudinal member and in said second opening of said first bracket of said third longitudinal member and said fourth longitudinal bar being received in said second opening of said first bracket of said second longitudinal member and in said second opening of said first bracket of said fourth longitudinal member;

a fifth, a sixth, a seventh and an eighth longitudinal bar, said fifth longitudinal bar being received in said first opening of said second respective bracket of said first longitudinal member and in said first opening of said second respective bracket of said second longitudinal member, said sixth longitudinal bar being received in said first opening of said second respective bracket of said third longitudinal member and in said first opening of said second bracket of said fourth longitudinal member, said seventh longitudinal bar being received in said second opening of said second respective bracket of said first longitudinal member and in said second opening of said second bracket of said third longitudinal member and said eighth longitudinal bar being received in said second opening of said second bracket of said second longitudinal member and in said second opening of said second bracket of said fourth longitudinal member;

each said longitudinal bar being slidable in the respective openings in which said respective bar is received; and, each said bracket having a first and a second aperture and receiving a thumb screw, each said thumb screw configured to restrict sliding of one of said respective bars received in said respective opening by tightening said respective thumb screw.

* * * * *